United States Patent [19]

Mandet et al.

[11] Patent Number: 4,664,594

[45] Date of Patent: May 12, 1987

[54] DEVICE FOR VARYING THE FLUID PASSAGE AREA BETWEEN ADJACENT TURBINE STATOR VANES

[75] Inventors: Gerard M. F. Mandet, Fericy; Jacques H. Mouchel, Paris, both of France

[73] Assignee: Societe Nationale d'Etude et de Construction de Moteur d'Aviation (S.N.E.C.M.A.), France

[21] Appl. No.: 826,894

[22] Filed: Feb. 6, 1986

[30] Foreign Application Priority Data

Feb. 6, 1985 [FR] France ..... 85 01618

[51] Int. Cl.[4] ..... F01D 17/14

[52] U.S. Cl. ..... 415/148; 415/150; 415/151

[58] Field of Search ..... 415/148, 150, 151, 157, 415/158, 126, 128

[56] References Cited

U.S. PATENT DOCUMENTS

| | | | |
|---|---|---|---|
| 1,201,492 | 10/1916 | Newton | 415/148 |
| 1,529,711 | 3/1925 | Parrott et al. | 415/157 |
| 2,083,447 | 6/1937 | Hoffmann | 415/148 |
| 2,531,896 | 11/1950 | Telbizoff | 415/151 |
| 2,565,178 | 8/1951 | Imbert | 415/126 |
| 2,858,974 | 11/1958 | Bullock et al. | 415/151 |
| 2,875,696 | 3/1959 | Von Zborowski | 415/148 |
| 4,403,914 | 9/1983 | Rogo et al. | 415/150 |
| 4,409,788 | 10/1983 | Nash et al. | 415/157 |
| 4,544,325 | 10/1985 | Rogo et al. | 415/150 |

FOREIGN PATENT DOCUMENTS

| | | | |
|---|---|---|---|
| 534209 | 1/1955 | Belgium | 415/150 |
| 977692 | 4/1951 | France . | |
| 95323 | 7/1970 | France . | |
| 50310 | 4/1978 | Japan | 415/151 |
| WO82/00686 | 3/1982 | PCT Int'l Appl. | 415/151 |
| 1073278 | 7/1967 | United Kingdom . | |

*Primary Examiner*—Robert E. Garrett
*Assistant Examiner*—John Kwon
*Attorney, Agent, or Firm*—Bacon & Thomas

[57] ABSTRACT

The present invention discloses a device for varying the fluid passage area between adjacent turbine stator vanes. Upstream and downstream baffles are pivotally attached to the turbine casing, such that their distal ends may be extended into and retracted from the fluid passage area, so as to vary the cross section of the throat between adjacent vanes. A control system interconnects all of the baffles so as to synchronize and positively control their movements. The invention finds particular use in an aircraft turbojet engine.

6 Claims, 6 Drawing Figures

Fig. 1
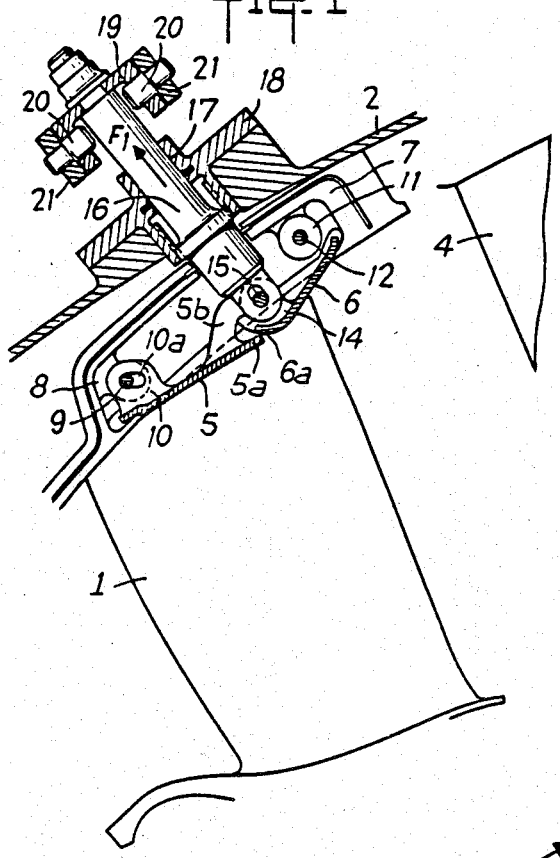
Fig. 2
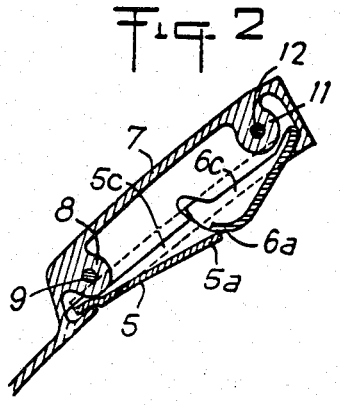
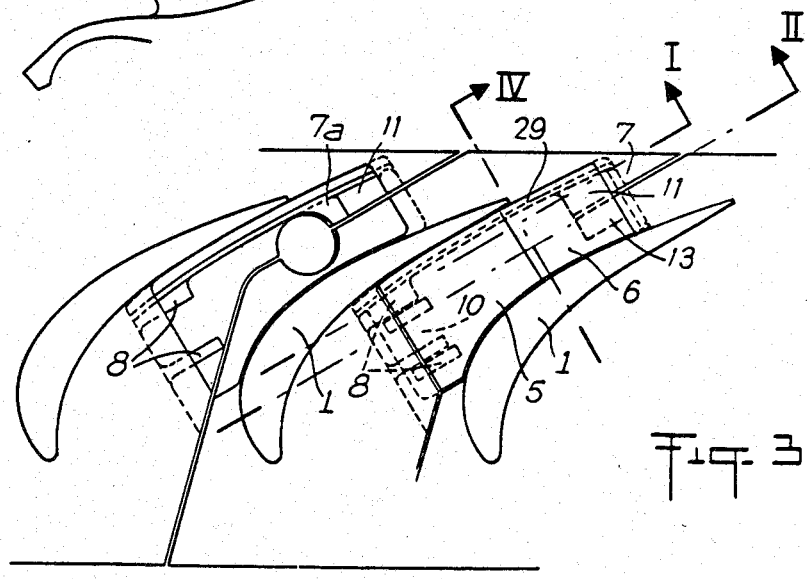
Fig. 3

Fig. 4
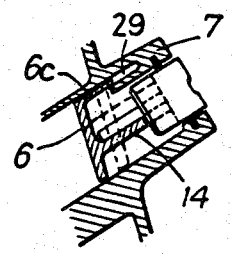
Fig. 5
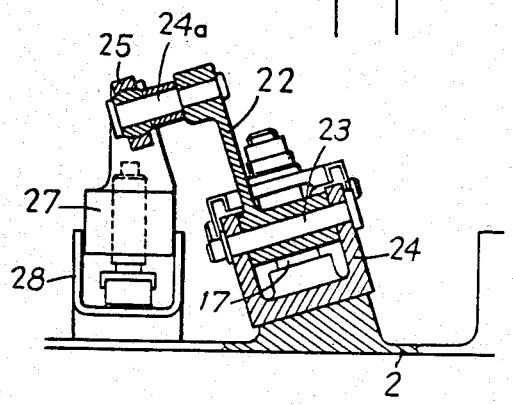
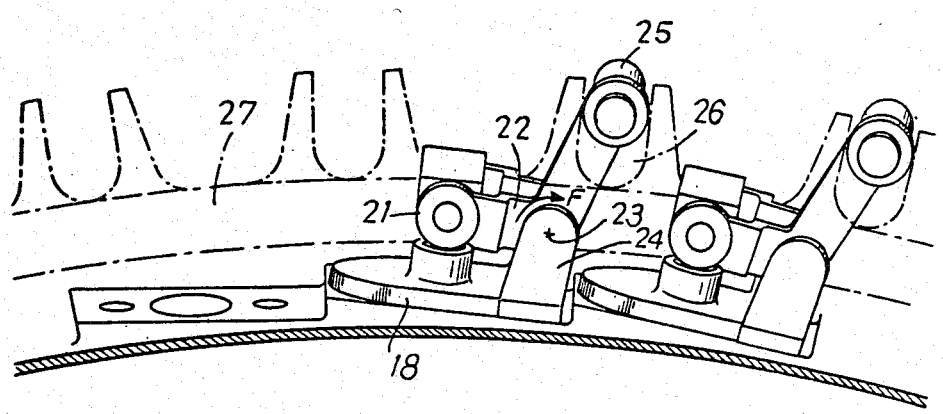
Fig. 6

DEVICE FOR VARYING THE FLUID PASSAGE AREA BETWEEN ADJACENT TURBINE STATOR VANES

FIELD OF THE INVENTION

The present invention relates to a device for varying the fluid passage area between adjacent turbine stator vanes, more specifically such a device which will accomplish its purpose while minimizing turbulence in the fluid passing over the stator vanes.

BRIEF DESCRIPTION OF THE PRIOR ART

It is well known that, in order to gain more thrust in a turbojet engine, the cross-sectional area of the throat of a stator vane guide system may be varied. The variation of the cross-sectional area of the throat may be achieved by aerodynamic means. However, such means typically cause a large reduction in efficiency and create fluid flow disorders across the stator vane assembly.

It is also known to vary the throat cross-sectional area by mechanical means, including varying the positions of the stator blades. However, these means are extremely complex and decrease the efficiency of the stator vane assembly by creating fluid flow leaks due to inadequate sealing.

It is also known to vary the cross-sectional throat area by incorporating a one-piece, hinged baffle member which may extend between adjacent stator vanes. The one-piece baffle is usually pivotally attached at its upstream edge portion and means are provided to extend the downstream edge portion into the throat area between the stator vanes. This system has not proven entirely successful, since it produces extreme turbulence in the fluid stream near the roots of the adjacent rotor blade assembly when the baffle members are in their extended positions.

SUMMARY OF THE INVENTION

The present invention provides a device for varying the fluid passage area between adjacent turbine stator vanes which avoids the drawbacks of the known prior art. The device comprises upstream and downstream baffle members, pivotally attached to the stator vane casing, such that they may be moved between a retracted position, which maximizes the fluid passage area, and an extended position in which the fluid passage area is reduced. The downstream baffle member is pivotally attached to the casing structure adjacent its downstream edge portion, while the upstream baffle member is pivotally attached to the casing adjacent an upstream edge portion. The downstream edge portion of the upstream baffle member is biased against the upstream edge of the downstream baffle member by the pressure of the fluid passing through the adjacent stator vanes.

Control means are provided to move the baffle members about their respective pivot axes, such that their distal, upstream and downstream edges may be moved into or retracted from the fluid passage area. In their retracted positions, the baffle members are substantially flush with the outer wall defining the fluid passage area. In their extended positions, the baffle members serve to restrict the fluid passage area.

The device according to the invention provides an effective means to vary the fluid passage area, while at the same time retaining the structural simplicity of having the stator vanes fixedly attached to the stator vane structure.

BRIEF DESCRIPTION OF THE DRAWINGS

FIG. 1 is a partial, cross-sectional view showing the device for varying the fluid passage area according to the invention.

FIG. 2 is a partial, cross-sectional view taken along line II—II in FIG. 3.

FIG. 3 is a partial plan view of a stator vane assembly incorporating the device according to the invention.

FIG. 4 is a partial, cross-sectional view taken along line IV—IV in FIG. 3.

FIG. 5 is a partial, cross-sectional view of the control device for controlling the positions of the baffle members.

FIG. 6 is a partial perspective view of the control assembly and its association with the stator vane structure.

DETAILED DESCRIPTION OF THE PREFERRED EMBODIMENT

The device according to this invention, as best seen in FIG. 1, serves to vary the fluid passage area between adjacent stator vanes 1, which are fixedly attached to casing 2 of the outer turbojet engine housing. The device is located between the adjacent stator vanes 1 upstream of an adjacent rotor wheel (not shown) having a plurality of movable turbine blades 4 attached thereto. The fluid passes over lateral surfaces of the stator vanes 1, which serve to direct the fluid onto the turbine blades 4.

The device comprises upstream baffle member 5 and downstream baffle member 6. Although it is to be understood that such members are provided between each pair of adjacent stator vanes, since all of the devices are identical, only one such device will be described in detail.

Upstream baffle member 5 is pivotally attached to support platform 7 adjacent an upstream edge portion. Support platform 7 is fixedly attached to casing 2 via known means. The means pivotally attaching upstream baffle member 5 to support platform 7 comprises a fixed yoke 8, formed in platform 7 and a boss 10, formed on the upstream baffle member 5, which defines a slotted opening 10*a* therethrough. Hinge pin 9 extends between the fixed yoke 8 through the slot lO*a*, so as to pivotally attach the upstream baffle member 5 to the support platform 7.

Similarly, platform 7 also defines a fixed yoke 11 at its opposite end. A boss 13, formed on the downstream edge portion of downstream baffle member 6 which also defines an opening therethrough. Pivot pin 12 extends through the yoke 11 and the boss 13, so as to pivotally attach the downstream baffle member 6 to the support platform 7. In FIG. 3, a support platform designated 7*a* is illustrated to clearly show the fixed bosses 8 and 11. The baffle members have been deleted from this platform for purposes of clarity, but it should be understood that in actual practice such baffle members are attached to platform 7*a*.

The downstream edge portion 5*a* of upstream baffle member 5 contacts the upstream edge portion 6*a* of downstream baffle member 6, and is retained in such contact by the pressure exerted thereon by the fluid flowing through the passage area between the stator vanes 1. A projection 5*b* extends from the upstream baffle member 5 which may bear against the upper portion of the upstream edge 6a of downstream baffle member 6.

The control means for varying the positions of the baffle members 5 and 6 comprises a boss 14 which is attached to the upstream edge portion of downstream baffle member 6 and which, in turn, is connected to control rod 16. Control rod 16 is slideably mounted within bore 17 of boss 18, which is attached to casing 2. A yoke 19 is fixedly attached to the outer end of control rod 16, and is pivotally attached to yoke 21 via pivot pins 20. Yoke 21 is fixedly attached to a distal end of a first arm of control lever 22 as best seen in FIG. 5. Control lever 22 is pivotally attached to the casing 2 through boss 18, Yoke 24 and pivot pin 23. Control lever 22 also has a second arm which extends at an angle from the first arm on which is mounted pin 24a, and roller 25. Roller 25 is mounted so as to be rotatable with respect to pin 24a.

Control ring 27 is rotatably attached about casing 2 via guide ring 28 which prevents any axial movement of control ring 27. Rollers for other friction reducing means may be interposed between control ring 27 and fixed guide ring 28 to minimize the friction generated by relative movement of these elements. Control ring 27 is defined by a plurality of outwardly opening, generally "U" shaped notches 26. A roller 25 of each of the control levers 22 is located in notch 26, such that, as the control ring 27 is rotated, lever 22 is caused to pivot about pivot pin 23 so as to cause axial movement of control rod 16. Such axial movement causes the upstream and downstream baffle members to pivot about their attachment points so as to vary the area of the fluid flow passage.

Each of the baffle members 5 and 6 may be provided with aligned, upstanding sealing walls 5c and 6c, respectively. The upstanding sealing walls 5c and 6c are provided along one lateral edge of each of the baffle members and engage an elongated slit 29 formed along one side of support member 7. The interengagement of the sealing walls with the elongated slit serves to minimize leakage of the fluid passing through the passage area.

As seen in FIG. 1, the rotational movement of control ring 27 will cause control rod 16 to move in the direction of arrow F1 which, in turn, will retract the upstream and downstream baffle members 5 and 6 such that they are substantially flush with the outer wall defining the fluid flow passage.

The foregoing description is provided for illustrative purposes only, and should not be construed as in any way limiting this invention, the scope of which is defined solely by the appended claims.

What is claimed is:

1. In a turbine stator vane assembly having a plurality of stator vanes attached to a casing, such that the adjacent vanes define a fluid passage area between adjacent stator vanes comprising:

(a) a downstream baffle member pivotally attached to the casing adjacent a downstream edge portion, the downstream baffle member having an upstream edge portion extending between adjacent stator vanes;

(b) an upstream baffle member pivotally attached to the casing adjacent an upstream edge portion, the upstream baffle member having a downstream edge portion extending between adjacent stator vanes and bearing against the upstream edge portion of the downstream baffle member; and, (c) control means connected to the baffle members to move them about their pivot axes between retracted positions wherein they provide no restriction of the fluid flow area between adjacent stator vanes, and extended positions wherein the upstream edge portion of the downstream baffle member and the downstream edge portion of the upstream baffle member extend into the space between adjacent stator vanes so as to restrict the fluid flow area therebetween.

2. The improved stator vane assembly according to claim 1 wherein the control means comprises:

(a) a control rod slidably mounted in the casing having a first end attached to the downstream baffle member adjacent the upstream edge portion;

(b) a control ring rotatably attached to the casing;

(c) a control lever having first and second arms extending from a central portion, the control lever being pivotally attached to the casing at its central portion;

(d) first connecting means connecting a second end of the control rod to the first arm of the control lever; and, (e) second connecting means connectng the second arm of the control lever to the control ring.

3. The improved stator vane assembly according to claim 2 wherein the first connecting means comprises:

(a) a first yoke attached to the first arm of the control lever;

(b) a second yoke attached to the second end of the control rod; and, (c) pivot pin means extending through aligned openings in the first and second yokes so as to pivotably attach the first and second yokes.

4. The improved stator vane assembly according to claim 2 wherein the control ring defines at least one notch, and wherein the second connecting means comprises a roller attached to the second arm of the control lever such that the roller engages a notch in the control ring.

5. The improved stator vane assembly according to claim 1 further comprising:

(a) a support platform attached to the casing and extending between adjacent stator vanes;

(b) first pivot means pivotally attaching the downstream baffle member to the support platform adjacent the downstream edge portion; and, (c) second pivot means pivotally attaching the upstream baffle member to the support platform adjacent its upstream edge portion.

6. The improved stator vane assembly according to claim 5 wherein the support platform defines an elongated slit and further comprising upstanding sealing walls attached to the downstream and upstream baffle members, respectively, each of the sealing walls engaging the elongated slit to minimize leakage through the fluid passage.

* * * * *

UNITED STATES PATENT AND TRADEMARK OFFICE

CERTIFICATE OF CORRECTION

PATENT NO. : 4,664,594

DATED : May 12, 1987

INVENTOR(S) : MANDET ET AL.

It is certified that error appears in the above-identified patent and that said Letters Patent is hereby corrected as shown below:

Col. 2, line 47, "1Oa" should be --10a--.

Col. 4, line 28, "connectng" should be --connecting--.

Signed and Sealed this

Twenty-seventh Day of October, 1987

*Attest:*

DONALD J. QUIGG

*Attesting Officer*

*Commissioner of Patents and Trademarks*